US007217876B2

(12) United States Patent
Allen et al.

(10) Patent No.: US 7,217,876 B2
(45) Date of Patent: May 15, 2007

(54) STRINGS FOR MUSICAL INSTRUMENTS

(75) Inventors: John C. Allen, Paoli, PA (US); John E. Bacino, Newark, DE (US); Chao Chu, Hockessin, DE (US); Edward J. Daniel, Landenberg, PA (US); Dean J. Gambale, Wilmington, DE (US); Alex R. Hobson, Elkton, MD (US); Paul J. Zuk, Lincoln University, PA (US)

(73) Assignee: Gore Enterprise Holdings, Inc., Newark, DE (US)

( * ) Notice: Subject to any disclaimer, the term of this patent is extended or adjusted under 35 U.S.C. 154(b) by 509 days.

(21) Appl. No.: 10/713,699

(22) Filed: Nov. 14, 2003

(65) Prior Publication Data

US 2005/0103180 A1 May 19, 2005

(51) Int. Cl.
*G10D 3/00* (2006.01)

(52) U.S. Cl. ..... 84/297 R

(58) Field of Classification Search ..... 84/297 R, 84/297 S, 290

See application file for complete search history.

(56) References Cited

U.S. PATENT DOCUMENTS

| | | | | |
|---|---|---|---|---|
| 2,049,769 | A | 8/1936 | Gray | 84/199 |
| 3,826,171 | A | 7/1974 | Kaar | 84/297 |
| 3,953,566 | A | 4/1976 | Gore | 264/288 |
| 3,962,153 | A | 6/1976 | Gore | 260/2.5 |
| 4,063,674 | A | 12/1977 | Stone et al. | 228/173 |
| 4,096,227 | A | 6/1978 | Gore | 264/210 |
| 4,187,390 | A | 2/1980 | Gore | 174/102 |
| 4,326,444 | A | 4/1982 | Markley | 84/297 |
| 4,339,499 | A | 7/1982 | Tappe et al. | 428/373 |
| 4,382,358 | A | 5/1983 | Tappe et al. | 57/243 |
| 4,383,465 | A | 5/1983 | Conklin, Jr. | 84/199 |
| 4,539,228 | A | 9/1985 | Lazarus | 427/180 |
| 5,009,142 | A | 4/1991 | Kurtz | 84/454 |
| 5,026,591 | A | 6/1991 | Henn et al. | 428/198 |
| 5,107,852 | A | 4/1992 | Davidson et al. | 128/772 |
| 5,535,658 | A | 7/1996 | Kalosdian | 84/297 |
| 5,610,348 | A * | 3/1997 | Aladin et al. | 84/297 S |
| 5,801,319 | A | 9/1998 | Hebestreit et al. | 84/297 |
| 5,883,319 | A | 3/1999 | Hebestreit et al. | 84/297 |
| 5,907,113 | A * | 5/1999 | Hebestreit et al. | 84/297 R |
| 5,984,878 | A * | 11/1999 | Engelson | 600/585 |
| 6,248,942 | B1 | 6/2001 | Hebestreit et al. | 84/297 |
| 6,348,646 | B1 | 2/2002 | Parker et al. | 84/297 |
| 6,528,709 | B2 | 3/2003 | Hebestreit et al. | 84/297 |
| 6,833,153 | B1 * | 12/2004 | Roorda et al. | 427/2.24 |
| 2004/0235984 | A1 * | 11/2004 | Nicholl et al. | 523/200 |

FOREIGN PATENT DOCUMENTS

| | | |
|---|---|---|
| DE | 963830 | 5/1957 |
| DE | 3133231 A | 3/1983 |
| DE | 33260061 | 1/1985 |
| DE | 4019334 A1 | 11/1992 |
| GB | 690031 | 4/1953 |
| GB | 2187217 A | 9/1987 |
| JP | 88057799 | 11/1988 |
| JP | 6-50089 | 7/1994 |
| JP | 63182441 | 7/1998 |
| WO | WO 90/01766 | 2/1990 |

* cited by examiner

*Primary Examiner*—Kimberly Lockett
(74) *Attorney, Agent, or Firm*—Kevin J. Boland

(57) ABSTRACT

Novel musical instrument strings and methods for making the same. Polymer cover combined with a low temperature resin is provided to the strings. Also disclosed are novel plastic materials comprising a film of porous fluoropolymer having UV-cured resin applied to at least a portion of the porosity of the film.

76 Claims, 10 Drawing Sheets

STRINGS FOR MUSICAL INSTRUMENTS

BACKGROUND OF THE INVENTION

1. Field of the Invention

The present invention relates to strings for musical instruments, and particularly to strings for musical instruments such as strings for guitars and the like that may be contaminated along their length and/or may cause undue finger discomfort when played.

2. Description of Related Art

There are a multitude of different types of musical strings employed today, each performing a different function. A typical guitar employs a straight (non-wound) string (such as "gut," metal, or synthetic polymer (e.g., those disclosed in U.S. Pat. Nos. 4,339,499 and 4,382,358)) for higher pitched notes, and wound metal or polymer strings (usually a wrapped metal or polymer winding over a core of metal, nylon or similar material) for lower pitched notes. Wound strings rely on the additional string mass per unit length supplied by the spiral wrap of the wound string to supply lower pitched notes at an acceptable string tension. Existing string designs have been refined over many years to provide excellent musical tones, but the strings continue to be limited in many respects.

There is a large variety of stringed musical instruments employed today that require human contact along at least a portion of the strings, such as in the fingering and plucking of guitar strings in order to be played. While straight gage strings can be easily wiped of dirt and oil after use, wound strings tend to become contaminated with dirt, skin oils, and perspiration after even a few hours of playing. It is believed that dirt and other contaminants infiltrate windings of the string causing the windings to have limited motion. After a relatively short period of time, a typical wound string will become musically "dead", apparently due to the build-up of this contamination. Presently wound strings that lose their tonal qualities must be removed from the instrument and either cleaned or replaced. This process is burdensome, time consuming, and expensive for musicians who play frequently and care about tonal quality.

Another problem encountered with strings requiring fingering along a fingering board (e.g., a guitar fret board) is that a substantial amount of pressure must often be applied by the musician against the fingering board in order to produce different musical notes. This can be discouraging for beginning music students. Accomplished musicians normally develop extensive calluses on their fingers from years of playing their instruments. Despite such calluses, the pressure and friction generated by playing the instruments tends to be one of the primary causes of frustration and fatigue or injury for many musicians.

Still another problem with conventional strings, and particularly conventional wound strings, is that the action of fingering quickly across the strings often generates unwanted noises. For instance, it is common to hear a "squeak" from guitar wound strings as a musician fingers rapidly across a fret board or finger board. In order to avoid such squeaks, the musician must make a concerted effort to completely separate his or her fingers from the strings when repositioning on the fret or finger board. This repositioning action slows the musician's note changes and further increases fatigue.

FIG. 1 illustrates a conventional classical guitar 10. Conventional classical guitars include a "fret" or "fingering board" 12, across which multiple strings, 14*a*, 14*b*, 14*c*, 16*a*, 16*b*, and 16*c*, are strung and against which the strings are pressed to form different notes as the strings are picked or plucked. A typical classical guitar includes three relatively "high" note (or "treble") strings, 14*a*, 14*b*, 14*c*, and three relatively "low" note (or "bass") strings, 16*a*, 16*b*, 16*c*. High note strings 14 are generally formed from a straight "non-wound" material, such as gut or synthetic material. In order to achieve significantly lower notes without increasing the length of the string or unduly increasing its thickness, bass strings 16 generally employ a wound string construction.

The form of a typical wound bass string 16 can be seen inside the string 18 illustrated in FIGS. 2 and 3. As is shown, wound bass strings 16 employ a core 20 and a winding wrapped repeatedly around the core 20. The winding is held in place around the core by tension and the anchoring of it at its ends.

When a conventional wound bass string 16 is played for a period of time, it tends to lose its tonal quality due to "contamination" of the string. It is believed that proper tonal quality of a wound bass string 16 is dependent upon allowing movement between individual wraps 24*a*, 24*b*, 24*c*, etc., of the winding during play. Contamination in the form of dirt, oil, sweat, etc., tends to become entrapped within the winding, causing limited motion of the individual wraps 24. This is a particular problem on a finger board of an instrument because of the constant handling of the strings in that area. As a result, after a relatively short period of play, wound bass strings begin to diminish in tonal quality. Professional musicians who care about tonal quality are then often required to remove and replace or clean the wound bass strings on a regular basis to maintain proper sound.

It would seem that some of these problems could be addressed if the strings could be coated with some substance to avoid contamination of the wound string windings and/or to provide some cushioning or smooth, non-squeak, cover for the strings. For example, Fender Corporation offers a bass guitar string that employs a spiral wrap of a flat, stiff polymer tape (such as nylon) around the wound string. The polymer tape is not adhered to the wound string and does not conform to the underlying bass string, but, instead, is held in place merely by tightly helically wrapping the stiff flat tape around the bass string and holding the tape from unwinding with an outer-wrapping of thread at each end of the guitar string. The polymer tape is wrapped with its side edges abutting without overlap of or adhesion to adjacent tape wraps.

While Fender Corporation's use of a stiff tape wrap may help reduce some contamination problems or may make the string somewhat more comfortable to play (neither of which results appears to be claimed or established by Fender), the Fender bass guitar string has a distinctly "dead" sound when played. The relatively heavy and stiff wrapping is believed to limit the amount and duration of vibration of the string, particularly at higher harmonic or overtone frequencies, muffling or "deadening" its sound. As a result of the use of such a non-deformable covering, the string is unsuitable for most guitar applications where a conventional "bright" or "lively" guitar sound is sought.

Moreover, a more recent improved musical instrument string is disclosed in, for example, U.S. Pat. Nos. 6,528,709; 6,248,942; 5,907,113; 5,883,319; and 5,801,319 to Hebestreit et al. These patents disclose various wound strings, such as a string having a center core and a spiral winding used to produce lower notes, and a variety of polymer covers or coatings applied around or to the wound string. FIGS. 2 and 3 illustrate a representative wound string disclosed by Hebestreit et al. As can be seen polymer cover 26 comprises a polymer material helically wrapped about the windings of the string. The preferred cover comprises porous polytetrafluoroethylene (PTFE) in the form of one or more tapes, sheets, or tubes that enwrap the wound string and protect the wound string from contamination. The cover is selected and applied so as not to significantly degrade the normal sound of the musical instrument. Thus, it is disclosed that the cover is substantially a non-dampening cover. Commercially available products produced according to the teachings of these patents are available from W. L. Gore and Associates, Inc., under the trademark ELIXIR® strings. ELIXIR® strings have overcome the above problems (e.g., string contamination, squeaking noise, etc.), while assuring exceptional tonal quality.

It is well known that guitar strings are designed specifically for at least four general types of guitars: acoustic guitars; electric guitars; bass guitars; and classical guitars. Guitar strings for acoustic and electric guitars include strings for higher pitched notes, generally made from steel, and strings for lower pitched notes, including a steel core and a metal winding (e.g., brass, etc.) around the steel core to produce the desired lower pitched sound (hereinafter referred to as "wound strings"). Bass guitars generally include only wound strings comprising a steel core and metal winding construction. Classical guitars include strings for higher pitched notes, made from animal intestines (hereinafter "gut") or a synthetic resin material such as polyamide 6, polyamide 6, 6, copolymers thereof, or more recently introduced, polyetheretherketone (PEEK) (hereinafter collectively referred to as "synthetic"). Wound strings for classical guitars generally include a gut or synthetic core (which can be a multifilament construction) including a metal winding around the core to produce the desired lower pitch sound, and have many of the same problems as wound strings which include a steel core (e.g., contamination, unwanted squeaking noise, etc.). Although musical instrument strings comprising gut or synthetic core material are typically used for classical guitars, such strings may find use in other musical instruments. Thus, as used herein and in the claims "classical guitar strings" includes any musical instrument string having gut or synthetic material as the core.

Due to the relatively lower melting temperature of the core material used in many classical guitar strings, some of the high-temperature processes for attaching the cover material to the string taught by Hebestreit et al. may be difficult to apply to temperature-sensitive gut or synthetic core material. Thus, a need exists for providing a suitable cover material to musical instrument strings having temperature-sensitive gut or synthetic core, as well as a method for applying such a cover in a manner which will not compromise the underlying material.

It is a purpose of the present invention to provide such a cover to a musical instrument string.

It is a further purpose of the present invention to provide an improved string, and particularly a string comprising gut or synthetic material, that maintains close to a conventional lively sound while being resistant to contamination over a longer period of time than conventional strings.

It is a further purpose of the present invention to provide an improved wound string, and particularly a string comprising gut or synthetic material, that is easier and/or more comfortable to play than conventional strings.

It is still another purpose of the present invention to provide an improved wound string, and particularly a string comprising gut or synthetic material, that is less prone to generating unwanted noises when a musician's fingers are moved along the string.

It is still another purpose of the present invention to provide a method for making such a string, and particularly a string comprising gut or synthetic material.

These and other purposes of the present invention will become evident from review of the following description.

SUMMARY OF THE INVENTION

The present invention includes improved strings for musical instruments and methods for making the same.

The string of the present invention can employ a conventional wound string, such as a string having a center core comprising steel, gut, or synthetic material and a spiral winding (e.g., metal or polymer) used to produce lower notes, and a polymer cover combined with low temperature resin. The polymer cover covers the string along at least a portion of its length. As the term "low temperature resin" is used herein it is intended to designate any resin that will either cure or form a durable bond when processed at a temperature less than about 300° C. More preferably, the resin comprises one that will either cure or form such a durable bond at less than about 275, 250, 225, 200, 175, 150, 125, 100, 75, 50, or 25° C.

The polymer cover can be combined with the low temperature resin by applying the low temperature resin to one or more surfaces of the polymer cover. In an alternative embodiment of the invention the polymer cover can comprise at least some porosity, wherein at least some of the porosity is filled with low temperature resin. In a further alternative embodiment of the invention the polymer cover can comprise at least some porosity, wherein at least some of the porosity is filled with low temperature resin and wherein low temperature resin is applied to at least one surface of the polymer cover.

In an aspect of the invention a suitable low temperature resin can be applied to at least one surface of the polymer cover and the low temperature resin may form a durable bond between the string and cover material.

In order to provide the highest compatibility with a wide variety of underlying string materials, it may be desirable to provide a resin material that can be applied, and if necessary cured, at or near room temperature, such as through use of pressure sensitive adhesives, UV or other light or radiation curable resins, or the like.

Particularly preferred resins include, for example, thermoplastic resins that have a Melt Flow Rate (MFR) of greater than about 1 gram/10 minutes under a test condition temperature of less than about 300° C. at a constant weight of about 5 Kg, as determined by ASTM D1238 (Melt Flow Rate Thermoplastics by Extrusion Plastometer). Further preferred resins that will cure or form a durable bond at low temperatures include thermoset resins. Particularly preferred resins include resins that can be cured through exposure to UV light.

DESCRIPTION OF THE DRAWINGS

The operation of the present invention should become apparent from the following description when considered in conjunction with the accompanying drawings, in which.

DETAILED DESCRIPTION OF THE INVENTION

The present invention relates generally to improved musical instrument strings.

The present invention comprises wrapping (or otherwise covering) a string (preferably a wound string) along at least a portion of its length with a polymer cover that is combined with low temperature resin. The polymer cover can be combined with the low temperature resin by: 1) applying the low temperature resin to one or more surfaces of the polymer cover; 2) by utilizing a polymer cover comprising at least some porosity, wherein at least some of the porosity is filled with low temperature resin; or 3) by utilizing a polymer cover comprising at least some porosity, wherein at least some of the porosity is filled with low temperature resin and wherein low temperature resin is applied to at least one surface of the polymer cover.

In an aspect of the invention a suitable low temperature resin can be applied to at least one surface of the polymer cover and the low temperature resin may form a durable bond between the string and cover material.

In order to provide the highest compatibility with a wide variety of underlying string materials, it may be desirable to provide a low temperature resin material that can be applied, and if necessary cured, at or near room temperature, such as through use of pressure sensitive adhesives, UV or other light or radiation curable resins, or the like.

Particularly preferred low temperature resins include, for example, thermoplastic resins that have a Melt Flow Rate (MFR) of greater than about 1 gram/10 minutes under a test condition temperature of less than about 300 C at a constant weight of about 5 Kg, as determined by ASTM D1238 (Melt Flow Rate Thermoplastics by Extrusion Plastometer). Further preferred low temperature resins that will cure or form a durable bond at low temperatures include thermoset resins. Particularly preferred low temperature resins include resins that can be cured through exposure to UV light.

The polymer cover of the present invention serves to seal the winding of the string from contamination during handling, while avoiding the problem of restricting movement of the individual wraps. Moreover, when a porous polymer cover is used, by filling at least some, or substantially all, of the porosity of the cover with resin, the mass and other properties of the cover material can be altered.

Figure 1:
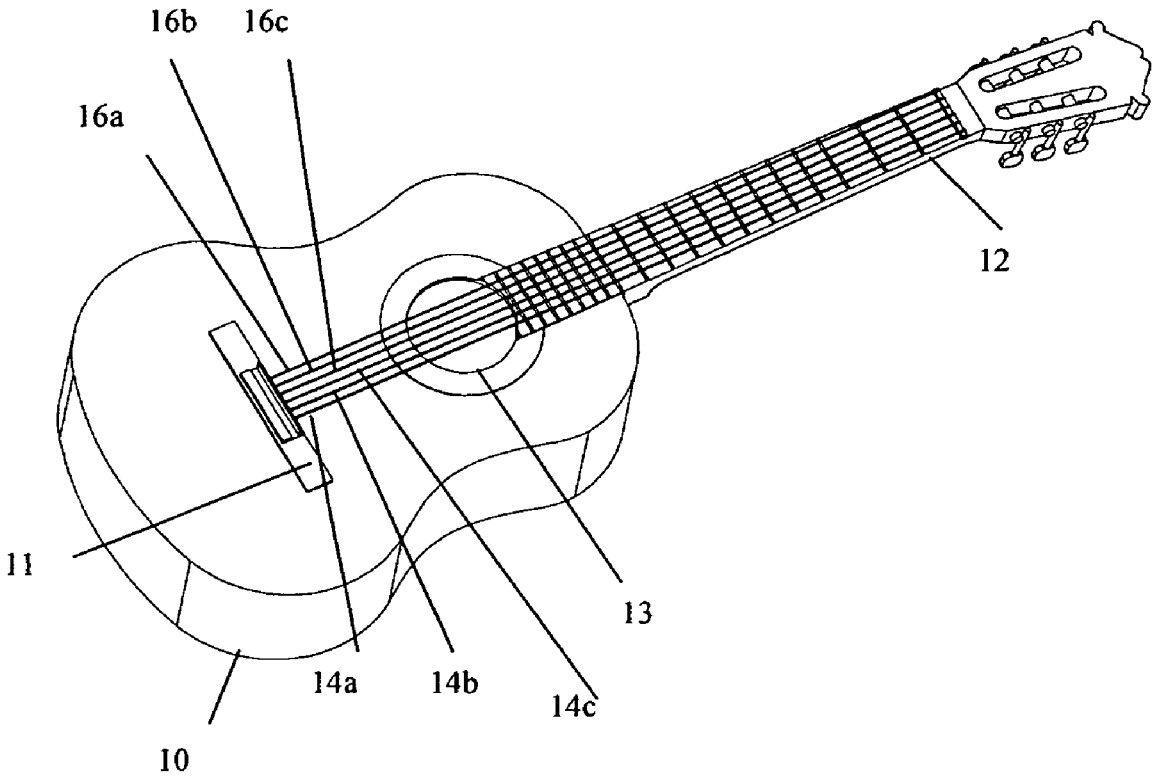
FIG. 1 is a three-quarter perspective view of a classical guitar.

For use on a guitar, it is believed to be important for the string to be covered at least along the fret board. It may be desirable to leave the string uncovered in the region where the string is strummed, picked or plucked so that the cover will not be exposed to harsh wear from fingernails, etc., imparted during the process of play. However, suitable strings of the present invention may include covers extending over the strumming, picking or plucking region of the string (generally the area of the sound hole 13 in FIG. 1). In an aspect of the invention the string is covered along at least the portion extending from the bridge 11 over the entire fret board 12. In a further aspect of the invention the entire length of the string is covered.

It has been discovered that the porous polymer cover aspect of the invention can be altered to withstand substantial wear and abrasion during use. Wear and abrasion resistance can be improved by, for example, careful selection of the resin used, the addition of certain filler materials, as well as the amount of porosity filled with the resin. Thus, by careful selection of resin type, amount of resin used, and filler material (if used), an extremely durable and abrasion resistant cover can be fabricated to withstand the abrasiveness of picks and/or fingernails applied to the strumming/picking portion of the string.

The present invention also solves the problem of string contamination with minimal diminishing of the lively sound of the string. The cover of the invention is deformable enough to allow movement of the wraps of the winding during play. Preferably, the cover is deformable enough to permit relatively free movement of the wraps even when the cover is at least partially adhered to the winding.

As the term "deformable" is used herein, it is intended to include any process or state whereby a covering material alters its shape under the normal pressures and stresses encountered by a musical instrument string. It is particularly preferable that a deformable cover used in the present invention allows for the normal movement of string windings along the longitudinal axis of the string while including at least some recovery (that is, elasticity) so that the cover tends to return to its original shape upon removal of the pressure or stress. The cover of the present invention should be sufficiently deformable along the length of the string so as to maintain the tonal quality of the string.

Materials suitable for use as the polymer cover of the present invention include, but are not limited to, the following: fluoropolymers; polytetrafluoroethylene (PTFE) particularly porous expanded PTFE (ePTFE); fluorinated ethylene propylene (FEP); polyethylene including ultrahigh molecular weight polyethylene; perfluoro alkoxy resin (PFA); polyurethane; polypropylene; polyester; polyimide; and polyamide.

Although the invention includes use of substantially non-porous polymer cover materials, particularly preferred are porous cover materials, and more preferably porous fluoropolymer films, with PTFE and ePTFE being even more preferred. The porosity of the porous polymer cover can be either partially or substantially completely filled with resin. For example, a relatively small amount of resin can be supplied to a select portion of the film porosity, while leaving most of the porosity of the film unfilled. This may result in a lower total film mass and may result in better tonal quality. In an aspect of the invention, resin can be evenly distributed throughout the porosity of the cover from one side of the cover to the other side, while still leaving at least some porosity unfilled. Moreover, in a further aspect of the invention, substantially all of the porosity of the film can be filled with resin to perhaps result in better abrasion resistance and better adhesion. However, fully filling the porosity may result in reduced tonal quality and increased film mass.

Figure 4:
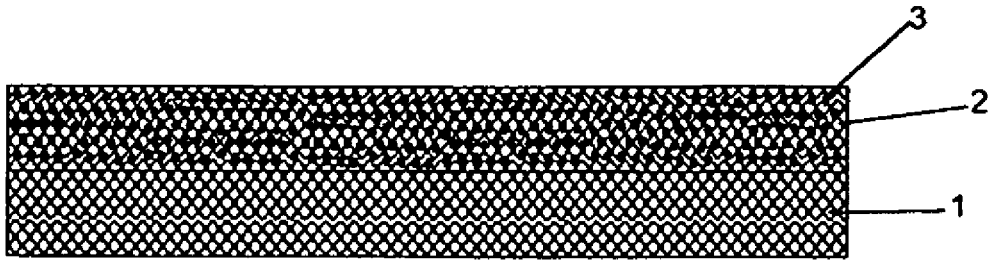
FIG. 4 is a schematic drawing of a porous film of the invention wherein at least some of the porosity of the film is filled with resin.
Figure 5:
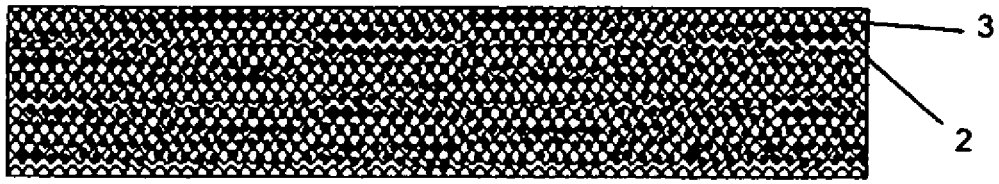
FIG. 5 is a schematic drawing of a porous film of the invention wherein substantially all of the porosity of the film is filled with resin.
Figure 6:
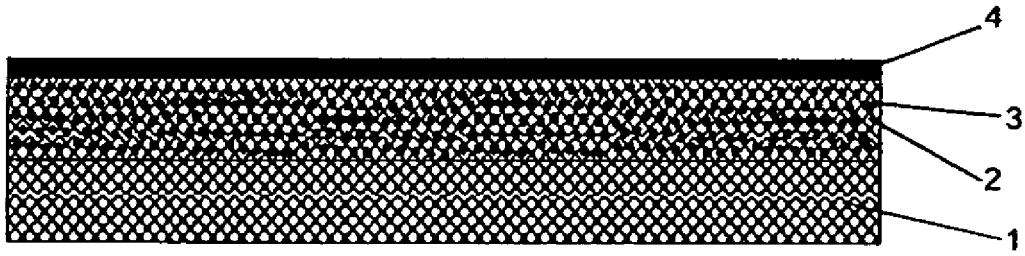
FIG. 6 is a schematic drawing of a porous film of the invention wherein at least some of the porosity of the film is filled with resin and one surface of the film is provided with a relatively thin layer of resin.
Figure 7:
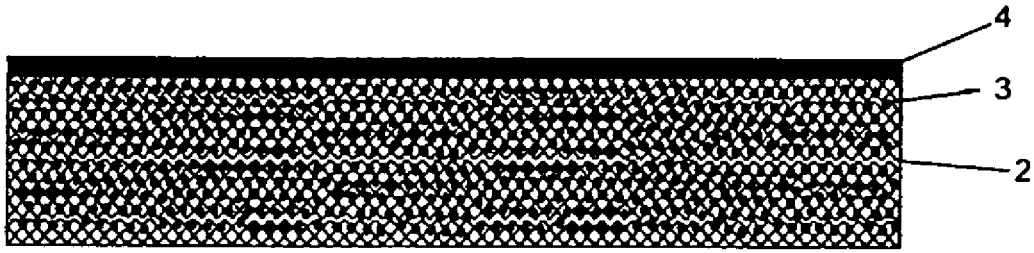
FIG. 7 is a schematic drawing of a porous film of the invention wherein substantially all of the porosity of the film is filled with resin and one surface of the film is provided with a relatively thin layer of resin.
Figure 8:
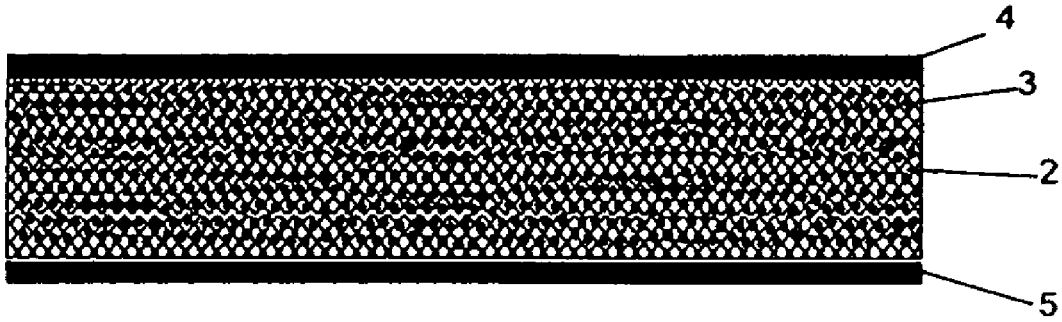
FIG. 8 is a schematic drawing of a porous film of the invention wherein substantially all of the porosity of the film is filled with resin and both surfaces of the film are provided with a relatively thin layer of resin.

Turning to the figures, FIG. 4 illustrates a porous cover material 1, where at least some of the porosity 2 is filled with resin 3. FIG. 5 illustrates a porous cover where substantially all of the porosity 2 is filled with resin 3. FIG. 6 illustrates an aspect of the invention wherein at least some of the porosity 2 is filled with resin 3 and an additional surface layer of resin 4 is supplied to one surface of the film. FIG. 7 illustrates an aspect of the invention where substantially all of the porosity 2 has been filled with resin 3 and an additional surface layer of resin 4 is supplied to one surface of the film. Finally, FIG. 8 illustrates an aspect of the invention where substantially all of the porosity 2 has been filled with resin 3 and both surfaces of the cover are supplied with a surface layer of resin 4 and 5. Although covers with any amount of porosity may be used, preferably the cover has a porosity of 50% or greater, before filling with resin. Moreover, porous covers having a mass per area of 5 $g/m^2$ or less are particularly preferred. Once the cover has been provided with, imbibed, or otherwise filled with resin, the preferred mass per area of the cover is 6 $g/m^2$ or less.

A preferred cover material is a porous fluoropolymer material such as uniaxially expanded polytetrafluoroethylene. This material has demonstrated exceptional durability with properties that maintain excellent tonal qualities for the covered string. Porous expanded PTFE, such as that made in accordance with U.S. Pat. Nos. 3,953,566; 3,962,153; 4,096,227; and 4,187,390, comprises a porous network of polymeric nodes and interconnecting fibrils. These kinds of material are commercially available in a variety of forms from W. L. Gore & Associates, Inc., Newark, Del.

Expanded PTFE is formed when PTFE is heated and rapidly expanded by stretching in at least one direction in the manner described in the above listed patents. The resulting expanded PTFE material achieves a number of exceptional properties, including exceptional strength in the direction of expansion, and exceptionally high flexibility, and conformability. Interestingly, although expanded PTFE material is quite strong and relatively non-deformable in the direction of expansion, the oriented characteristics of the fibrillar microstructure make the material relatively deformable and easily distorted in a direction other than the direction of stretch. As is known, the amount of strength and deformability of the expanded PTFE can be adjusted by varying the expansion procedures, providing a wide degree of strength, porosity, and deformability in different directions by changing the direction and amount of expansion.

As the term "expanded PTFE" is used herein, it is intended to include any PTFE material having a node and fibril structure, including in the range from a slightly expanded structure having fibrils extending from relatively large nodes of polymeric material, to an extremely expanded structure having fibrils that merely intersect with one another at nodal points. The fibrillar character of the structure is identified by microscopy. While the nodes may easily be identified for some structures, many extremely expanded structures consist almost exclusively of fibrils with nodes appearing only as the intersection point of fibrils.

Low temperature resins include any resin that will either cure or form a durable bond when processed at a temperature less than about 300° C. Suitable low temperature resins include any suitable thermoset resin. For example, suitable thermoset resins include epoxies (including acrylated epoxies), polyurethanes, phenolics, etc. Moreover, suitable thermoplastic resins include thermoplastic resins that have a Melt Flow Rate (MFR) of greater than about 1 gram/10 minutes under a test condition temperature of less than about 300° C. at a constant weight of 5 Kg, as determined by ASTM D1238 (Melt Flow Rate Thermoplastics by Extrusion Plastometer). Suitable thermoplastic resins include, for example, polyethylene, polypropylene, polystyrene, polyvinyl chloride, polyurethanes, and fluoropolymers such as THV (tetrafluoroethylene, hexafluoropropylene, and vinylide fluoride), HTE (hexafluoropropylene, tetrafluoroethylene, and ethylene), EFEP (ethylene tetra fluoro ethylene based copolymer), ETFE (ethylene tetrafluoroethylene), and PVDF (polyvinylidine fluoride), and blends thereof. Thermally activated resins which can cure or form a durable bond when the resin is heated, such as THV 220 (tetrafluoroethylene, hexafluoropropylene, and vinylide fluoride, available from Dyneon, LLC) and resins which can be caused to cure through chemical reaction, such as known moisture cure adhesives (e.g., polyurethane prepolymers, etc.) or other chemically activated adhesives, can be used.

In a preferred embodiment, the low temperature resin comprises UV-curable resin. UV-curable is defined as a material that will react under UV light to either cure or form a durable bond. The UV light can be provided by a lamp having a suitable voltage, a suitable strength, and a suitable wavelength. Curing with UV light may be carried out for any suitable length of time, and the distance between the sample being cured and the UV lamp can be any suitable distance. All of the above parameters will be readily determinable by one skilled in the art. In an aspect of the invention the UV curable material can also be sensitive to visible light. However, preferred conditions are present only under the UV spectrum (100–400 nm). The preferred range is in the UVA spectrum (320–390 nm). In this range, the underlying core material will not be damaged during the processing of the string. Suitable UV-curable resins include, for example, acrylated epoxies, acrylates, urethane acrylates, urethane methacrylates, silanes, silicones, epoxides, epoxy methacrylates, triethylene glycol diacetate, and vinyl ethers. Specific examples of these resins include acrylated aliphatic oligomers, acrylated aromatic oligomers, acrylated epoxy monomers, acrylated epoxy oligomers, aliphatic epoxy acrylates, aliphatic urethane acrylates, aliphatic urethane methacrylates, allyl methacrylate, amine-modified oligoether acrylates, amine-modified polyether acrylates, aromatic acid acrylate, aromatic epoxy acrylates, aromatic urethane methacrylates, butylene glycol acrylate, stearyl acrylate, cycloaliphatic epoxides, cylcohexyl methacrylate, ethylene glycol dimethacrylate, epoxy methacrylates, epoxy soy bean acrylates, glycidyl methacrylate, hexanediol dimethacrylate, isodecyl acrylate, isooctyl acrylate, oligoether acrylates, polybutadiene diacrylate, polyester acrylate monomers, polyester acrylate oligomers, polyethylene glycol dimethacrylate, stearyl methacrylate, triethylene glycol diacetate, and vinyl ethers. Preferred UV-curable resins include, for example, urethane acrylates and cationic epoxies.

In choosing a resin, it is very important to keep in mind that a resin may have the undesirable effect of adhering the windings of the string together, thereby limiting the vibration of the string.

When a porous polymer cover material is used, at least some, or substantially all, of the porosity of the porous polymer cover can be filled with low temperature resin. Additionally, the low temperature resin can also be provided as a continuous or discontinuous coating on one or both sides of the cover. The exact amount of resin used will depend upon a number of issues. For example, adding more resin may further improve durability and abrasion resistance, but may also dampen the higher frequencies of the covered string. Providing less resin may result in less durability and reduced abrasion resistance. However, less resin may tend to preserve the higher frequencies of the covered string.

It may be desirable to utilize a solvent to aid in providing resin to the porosity of the porous polymer cover. The ratio of solvent material to resin can vary and will be readily determinable by the skilled artisan. A 50/50 by weight solvent to resin solution has been found to be particularly acceptable. Preferable solvent materials will be readily apparent to one skilled in the art and include, for example, alcohols, ketones, etc. A preferred solvent is methyl ethyl ketone (MEK). When a solvent material is utilized, the solvent material can be easily removed or driven off once the resin is provided to at least some of the porosity of the porous polymer cover as desired.

In a further aspect of the invention, the low temperature resin can be combined (e.g., mixed, blended, etc.) with a suitable filler material. Suitable filler materials may include, for example, ceramics, metals, metal coated materials, metallized materials, carbon and polymers, which can be provided in any suitable form (e.g., particulates, fibers, etc.) Filler materials may be desirable to alter certain properties of the covered string (e.g., improve electrical conductivity, improve abrasion resistance, etc.). For example, for use on electric guitars or electric bass guitars, it may be particularly beneficial to provide electrically conductive filler material (i.e., filler material that is more conductive than the polymer cover, such as metals, carbon, etc.) to the cover. By providing electrically conductive filler material to the cover, better tonal quality of the strings may be obtained. Certain polymer cover materials may result in the underlying string being electrically insulated; thus, resulting in undesirable humming noise. Utilizing electrically conductive filler may result in reduced humming or other undesirable noises. Therefore, according to this aspect of the invention, any suitable polymer cover material (porous or substantially non-porous) can be fabricated to include a suitable filler material (and particularly an electrically conductive filler material) located in a portion of, throughout, and/or on one or both surfaces of the cover.

Use of solvent may be particularly useful when at least partially filling the porosity of a porous cover with a resin or a resin/filler material combination. This may be a particularly preferred way of introducing filler materials into the porosity of the porous cover.

Suitable resin application means include any method known in the art. With regard to porous polymer covers, suitable resin application means include, for example, coating techniques (e.g., dip coating), solvent imbibing, vacuum assisted coating, pressure assisted coating, nip coating, and other suitable means which would result in the resin filling at least some of the porosity of the porous polymer cover.

As stated above, a preferred porous polymer cover is expanded PTFE. At least a portion of the porosity of the expanded PTFE is filled with low temperature resin. In an aspect of the invention substantially all of the porosity of the expanded PTFE film is filled with low temperature resin. Furthermore, one or more surfaces of the expanded PTFE may be provided with a relatively thin surface layer of low temperature resin. Such surface layer(s) of resin can be either continuous or discontinuous. In a preferred embodiment the surface layer(s) of resin is a continuous layer. Preferably, the film is imbibed with a resin/solvent solution, thus allowing good penetration of the resin into the porosity of the film. Imbibing is accomplished by first preparing a resin/solvent solution, and second, combining this solution with a porous film like expanded PTFE. Solvents such as alcohols and ketones are capable of dissolving resin so that it can penetrate and occupy the porosity of the porous film. There are many suitable resins (e.g., urethanes, epoxies, etc.) that can be dissolved in suitable solvents. In an aspect of the invention the resin is UV-curable urethane-acrylate. This resin will also cure by other mechanisms such as through heating and chemical reaction.

The mass of resin delivered to the expanded PTFE film (or other polymer cover material) can be regulated by the solvent to resin ratio in the solvent/resin solution and by the rate at which it is applied. A spreading mechanism can be used to distribute the resin/solvent solution after it contacts the film surface. Once the film has accepted the resin/solvent solution, or becomes imbibed, the mechanical characteristics of the film can change and it may have the tendency to shrink. In order to stabilize the film, a suitable liner can be provided to the film following this step. An example of a suitable liner material is ACCUPLY® Laminating Release Film, available from Accurate Plastics, Inc. Another suitable liner material may be a silicone-coated paper. In any event, both the liner and the film can be contacted together and placed into a forced air oven. The heated air can be blown across the flat side of the film oriented with the non-liner side toward the air stream. This drives off the solvent and leaves the resin within the porosity of the film. The film can be removed from the liner before applying the film to the string.

Figure 9:
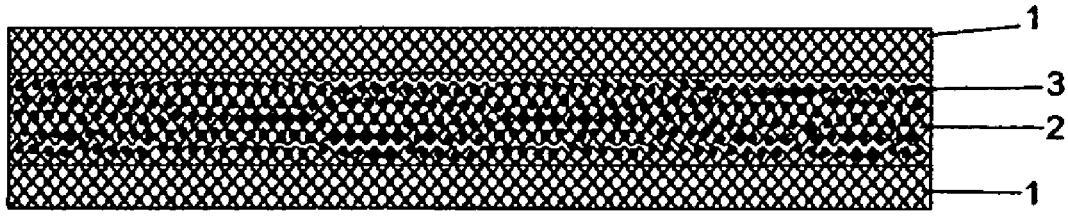
FIG. 9 is a schematic drawing of a porous film of the invention wherein at least some of the porosity of the film is filled with resin, but the resin is not coincident with the surfaces of the film.

This method can yield a number of different embodiments. For example, a partially filled cover 1 with the resin 3 not coincident with the surfaces of the cover, filling only a portion of the porosity 2, as shown in FIG. 9. As well as the embodiments previously described and illustrated in FIGS. 4 through 8.

Once the low temperature resin has been provided to at least one surface of the polymer cover, or once the low temperature resin has at least partially filled, or is otherwise provided to, the porosity of the cover (and the solvent driven off, if a solvent is used), the cover can then be placed in contact with the string and the low temperature resin can then be cured.

Figure 2:
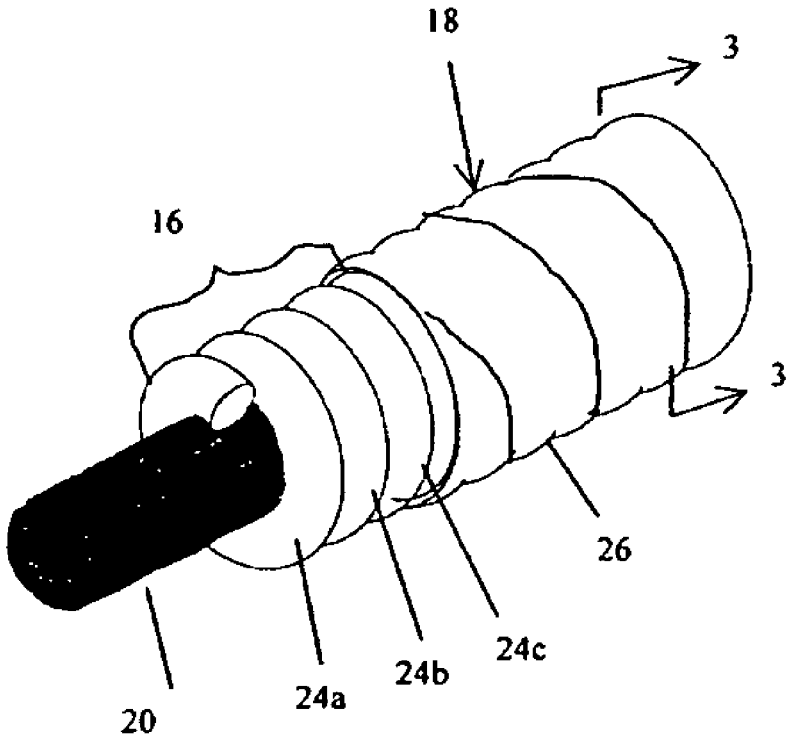
FIG. 2 is a three-quarter isometric view, partially in cut-away, of a prior art covered string construction.
Figure 3:
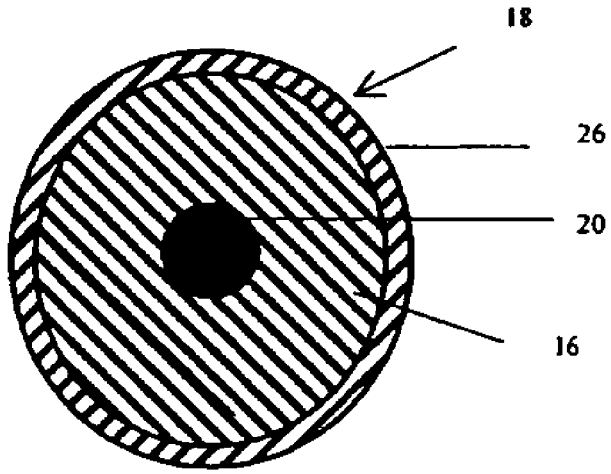
FIG. 3 is a transverse cross-section view along line 3—3 of FIG. 2.
Figure 10A:
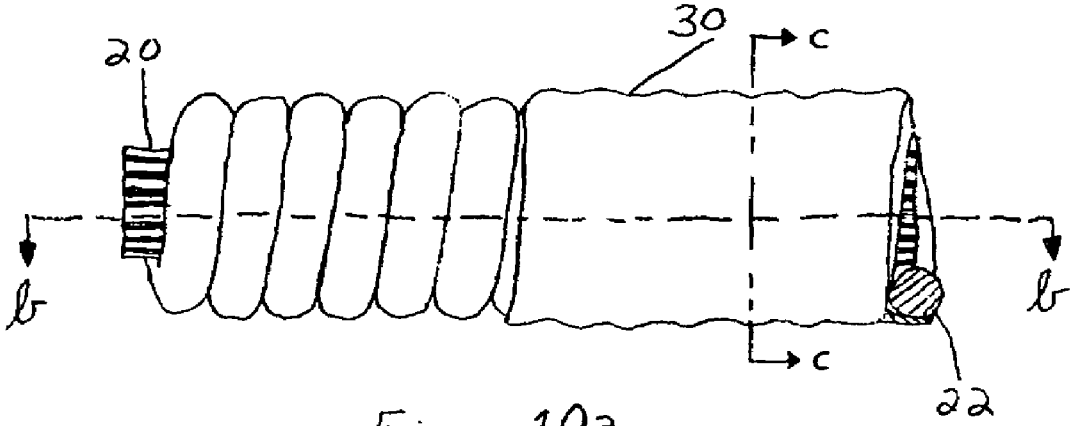
FIGS. 10*a* through 10*c* demonstrate a string construction according to the invention.
Figure 10B:
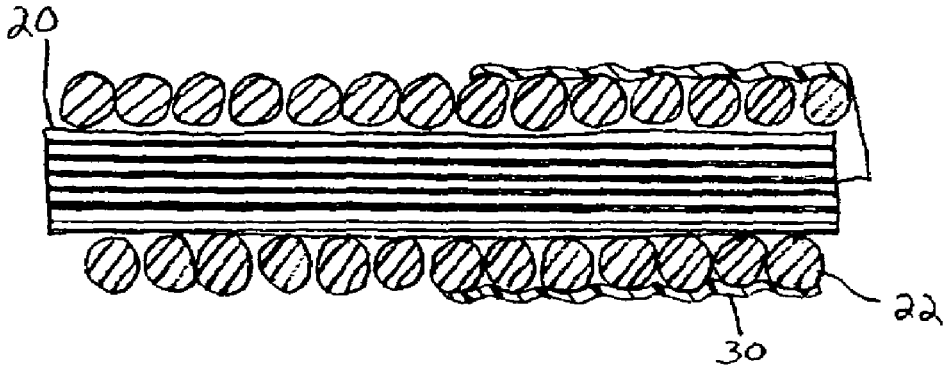
Figure 10C:
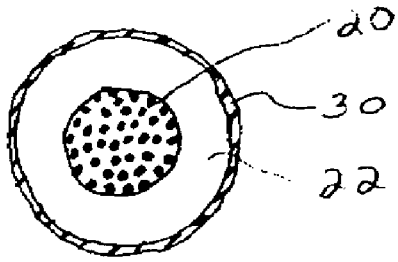
Figure 11A:
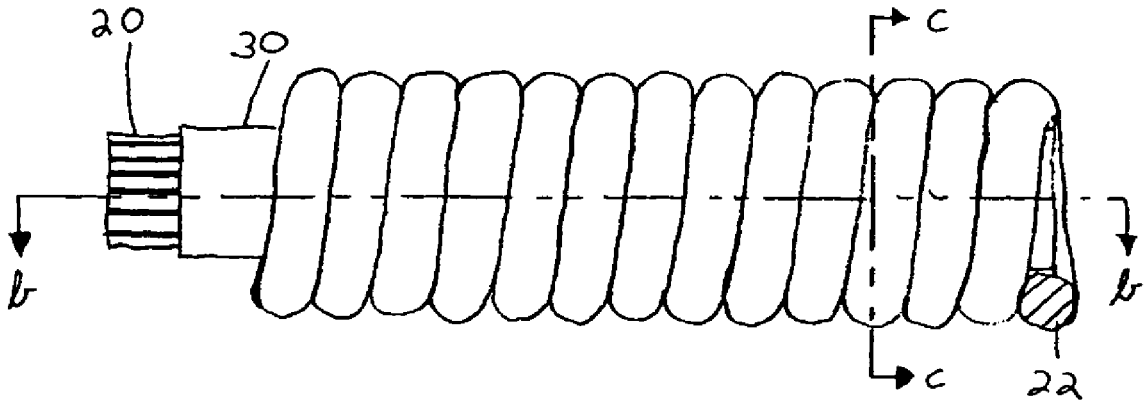
FIGS. 11*a* through 11*c* demonstrate a string construction according to the invention.
Figure 11B:
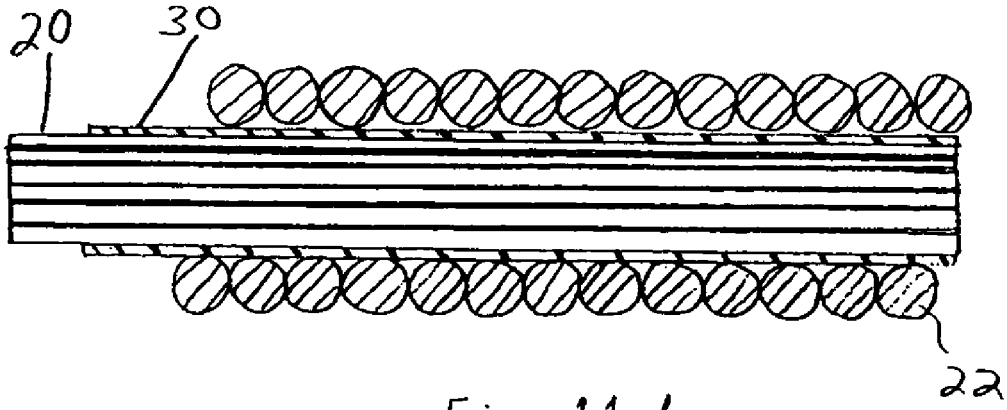
Figure 11C:
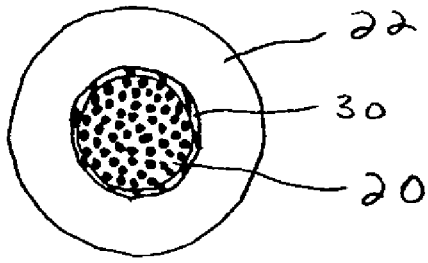
Figure 12A:
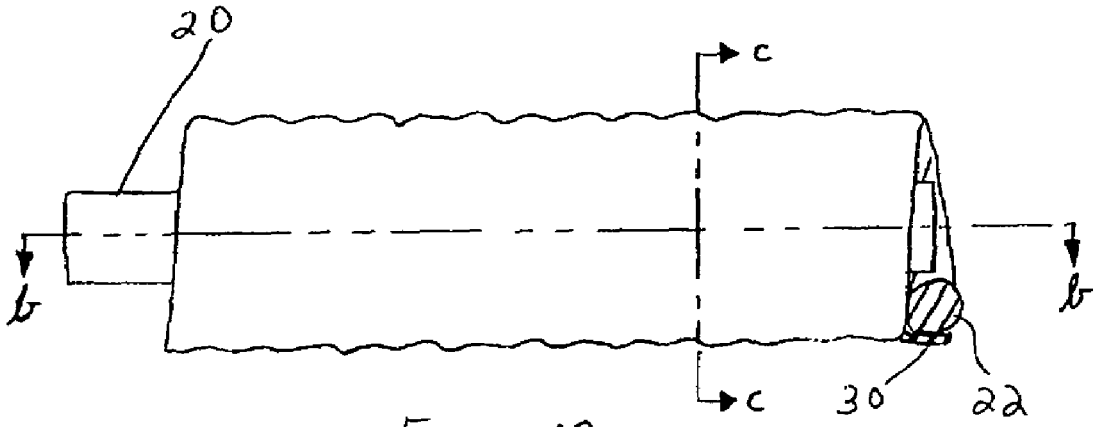
FIGS. 12*a* through 12*c* demonstrate a string construction according to the invention.
Figure 12B:
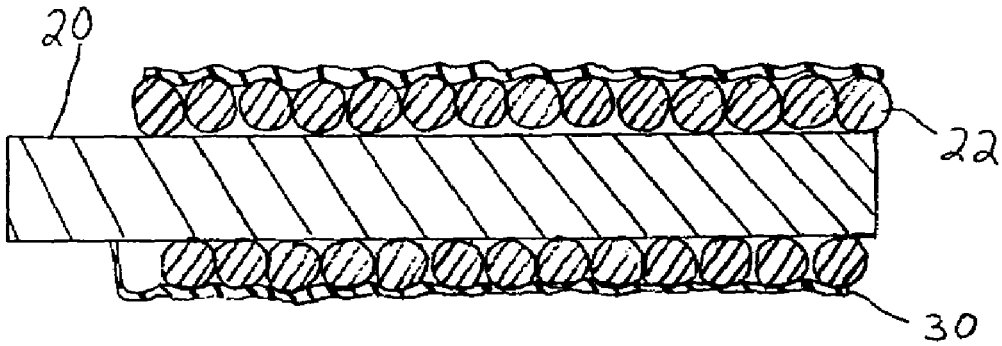
Figure 12C:
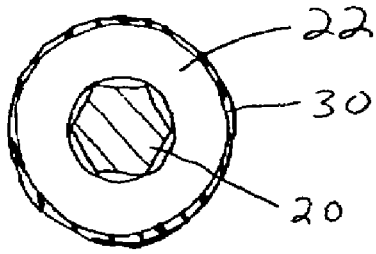
Figure 13A:
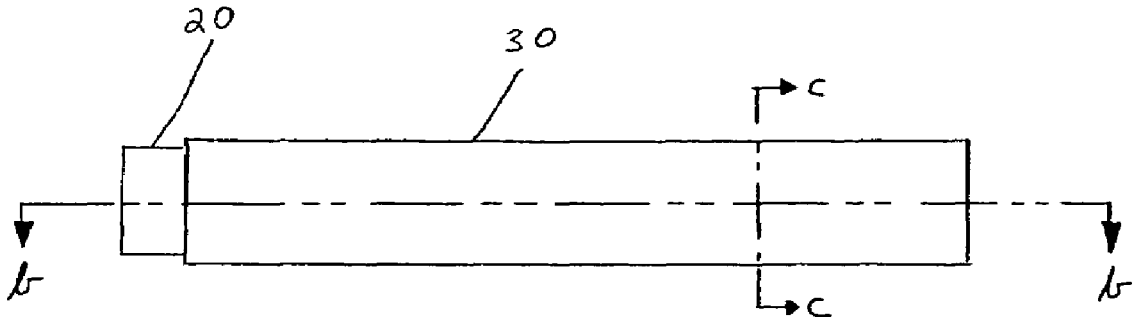
FIGS. 13*a* through 13*c* demonstrate a string construction according to the invention.
Figure 13B:
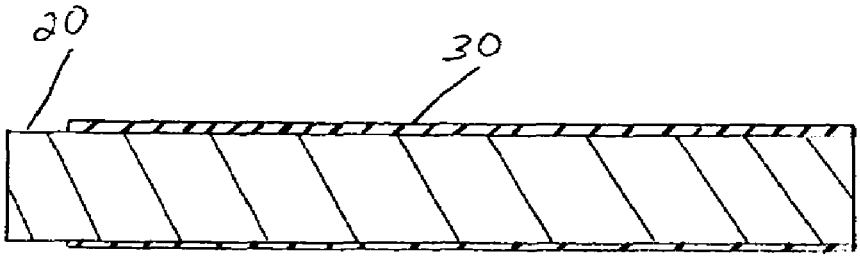
Figure 13C:
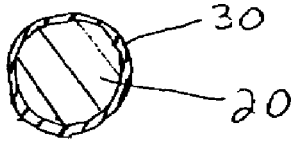
Figure 14A:
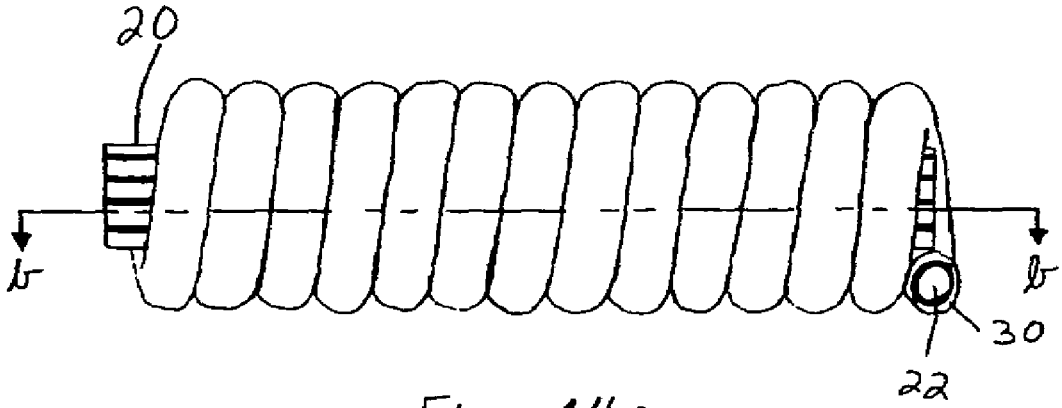
FIGS. 14*a* and 14*b* demonstrate a string construction according to the invention.
Figure 14B:
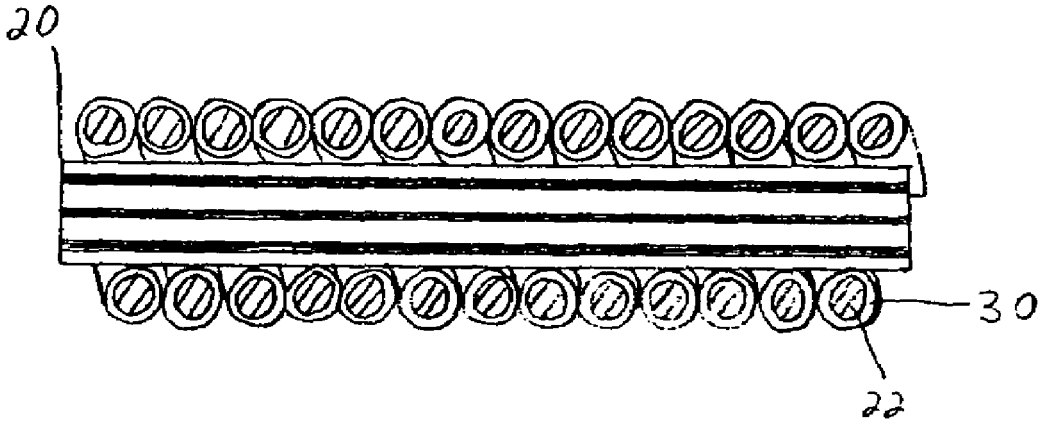

The preferred methods of applying the cover are described in U.S. Pat. No. 5,883,319. Suitable string constructions include, for example, those demonstrated in FIGS. 2 through 7 of U.S. Pat. No. 5,883,319. A particularly preferred construction includes helically wrapping the cover material about the string, as illustrated in FIG. 2. Further preferred, non-limiting, constructions are shown in FIGS. 10–14. Specifically, FIG. 10*a* shows a classical guitar string construction comprising a multifilament core material 20 wrapped with winding 22 wherein cover 30 is provided as a "cigarette" wrap, wrapped about the winding 22. FIG. 10*b* is a longitudinal cross-section of FIG. 10*a* taken along "b—b" of FIG. 10*a*. FIG. 10*c* is a cross-section of FIG. 10*a* taken along "c—c" of FIG. 10*a*. FIG. 11*a* shows a classical guitar string construction comprising a multifilament core material 20 wrapped with winding 22 wherein cover 30 is provided as a "cigarette" wrap, wrapped about the multifilament core 20. FIG. 11*b* is a longitudinal cross-section of FIG. 11*a* taken along "b—b" of FIG. 11*a*. FIG. 11*c* is a cross-section of FIG. 11*a* taken along "c—c" of FIG. 11*a*. FIG. 12*a* shows a guitar string construction comprising a core material 20 having a hexagonal cross-section wrapped with winding 22 wherein cover 30 is provided as a "cigarette" wrap, wrapped about the winding 22. FIG. 12*b* is a longitudinal cross-section of FIG. 12*a* taken along "b—b" in FIG. 12*a*. FIG. 12*c* is a cross-section of FIG. 12*a* taken along "c—c" of FIG. 12*a*. FIG. 13*a* shows a guitar string construction comprising a core material 20 wherein cover 30 covers the core material 20. This construction demonstrates an aspect of the invention wherein an unwound or higher pitched string is provided with a cover material. FIG. 13*b* is a longitudinal cross-section of FIG. 13*a* taken along "b—b" in FIG. 13*a*. FIG. 13*c* is a cross-section of FIG. 13*a* taken along "c—c" in FIG. 13*a*. Finally, FIG. 14*a* shows a guitar string construction comprising a multifilament core material 20 wrapped with winding 22 wherein cover 30 has been wrapped about the winding material 20 prior to the winding being applied to the multifilament core material 20. FIG. 14*b* is a longitudinal cross-section of FIG. 14*a* taken along "b—b" in FIG. 14*a*.

Although particularly preferred core materials include gut or synthetic materials, metal cores (e.g., stainless steel) may also benefit from the use of the covers of the invention. However, the covers are particularly attractive when used in combination with classical guitar strings.

Although gut and nylon are typical core material for classical guitar strings, the preferred core material for the classical guitar string of the invention is PEEK.

PEEK strings provide a brighter initial sound and higher temperature resistance than nylon.

Regardless of the type of core material used, once the string is provided with the cover, the low temperature resin can be cured to result in the covered string of the invention.

The particular curing mechanism used, such as heat, UV radiation, and chemical reaction, will depend on the type of resin used. One preferred resin is urethane-acrylate, which is capable of curing via heating and/or UV radiation. The preferred mechanism for curing this resin on a synthetic core string is UV radiation because of its relatively low temperature application.

As discussed above, high temperature processes can degrade the tone of strings with synthetic components. Degraded tone is observed as a reduction of high frequency intensity, or brightness. In this regard the tone of strings made with a core of nylon 6,6 can become degraded when processed above about 120° C. The tone of strings made with a core of PEEK can become degraded when processed above about 150° C. Thus, in an aspect of the invention preferred low temperature resins include resins that can be cured at a temperature of about 150° C. or less and, in a further aspect of the invention, at a temperature of about 120° C. or less.

Higher process temperatures required for some resins may degrade the tone if they are used in combination with these strings. Hebestreit et al. describe a preferred material as being FEP, which is provided as a coating material to an expanded PTFE cover material which is wrapped about a wound string. As described in the patent the wound string construction is processed at temperatures in excess of 300° C. Processing synthetic strings at these high temperatures can damage the string both musically and mechanically.

To cure the resin by UV radiation, the covered string can be placed in tension above a sheet of PTFE. Tension will keep the covered string straight. The PTFE will act as a reflective surface and should span the length of the string. Important parameters for the UV curing process are spectral intensity of UV light, measured by watts/cm$^2$, and spectral dosage of UV light, measured by Joules/cm$^2$. Although any suitable parameters may be useful, the preferred UV spectrum is UVA (320–390 nm). The preferred intensity and dosage in the UVA spectrum is at least 1.3 watts/cm$^2$ and 4 Joules cm$^2$, respectively. Upon exiting the UV oven, the string should have a tack free surface indicating that the resin has cured.

In an aspect of the invention at least two layers of expanded PTFE, each having been stretched in a longitudinal direction, with each of the expanded PTFE layers wrapped at different angles to each other, are provided. This is accomplished by two sequential helical wrappings applied over the string at approximately equal but opposite pitch angles which are measured respectively from opposite ends of the longitudinal axis of the string; i.e., the pitch angles of the first and second wrappings are measured from opposite ends of the string. This construction is believed to provide excellent strength and durability while maintaining good deformability along the length of the string.

Of course, polymeric coverings may also be provided for straight (non-wound) strings as well as for wound strings. Such a covering on a straight string provides, among other things, increased lubricity and consequently allows faster and more comfortable playing. The covering may be provided along only a portion of the length of a string if desired, as discussed above.

The invention also relates to the novel embodiment of porous fluoropolymer films wherein low temperature resin is applied to the film. Furthermore, as with the guitar string embodiment of the present invention, the porosity of the fluoropolymer film may be either partially filled or substantially completely filled with low temperature resin, and may also be provided with at least one thin surface layer of low temperature resin. Therefore, the novel porous fluoropolymer film having low temperature resin applied to the film can be provided to any suitable material that would otherwise be damaged by relatively high temperature processing. Thus, in a further aspect of the invention, the invention relates to a plastic material comprising a film of porous fluoropolymer having top and bottom surfaces, and low temperature resin applied on at least one of the top and bottom surfaces of the film. Such a plastic material can be provided, for example, as a cover material to any suitable material and the material processed to cure the low temperature resin, thus resulting in a suitable bond between the film of fluoropolymer and the underlying material. In this aspect of the invention, UV-curable resin is a particularly preferred low temperature resin.

Without intending to limit the scope of the present invention, the following examples illustrate how the present invention may be made and used:

EXAMPLES

Example 1

The wound classical strings from a set of hard tension D'Addario composite (PEEK) classical strings (part number EJ46C) were covered with a film imbibed with UV-curable resin. There were 3 wound strings of varying diameter in this set. The following is a description of each string and its individual D'Addario part number:

| String | Diameter | D'Addario Part Number |
|---|---|---|
| E-6 | 0.046" | J4606C |
| A-5 | 0.036" | J4605C |
| D-4 | 0.029" | J4604C |

Expanded PTFE with a mass area of about 1.1 g/m$^2$ and a thickness of about 0.0025 mm was obtained from W. L. Gore & Associates, Inc., Newark, Del. The film had an initial porosity of about 80%.

A 50/50 by weight MEK solvent to resin solution was prepared for imbibing the expanded PTFE film. The MEK used was electronic grade, residue free, supplied by Acros Organics N. V., Fair Lawn, N.J. The resin used was 621 Series MULTI-CURE® urethane acrylate manufactured by Dymax Corporation, Torrington, Conn. This solvent-resin solution was dispensed and spread evenly across the expanded PTFE film. An ACCUPLY® Laminating Release Film was used as a liner and combined with the film as the solvent-resin solution penetrated the expanded PTFE film. Both the liner and imbibed film were sent through an oven (set at about 125° C.) to drive off the MEK solvent. The film was removed from the oven and a substantially fully imbibed structure with imbibed resin coincident with both surfaces of the film and a thin surface coat of resin present on the liner side was recovered. The thin surface coat substantially completely covered the expanded PTFE surface.

The thickness of the imbibed film was measured to be about 0.0033 mm. The mass area of the imbibed film was measured to be about 2.7 g/m$^2$.

The imbibed film was wrapped in a helical fashion around each string as described in U.S. Pat. No. 5,883,319. The surface coat side of the imbibed film was oriented toward each string. The resultant construction was a string with 2 layers of imbibed film covering the entire playing length of the string.

Each covered string was placed in tension and attached above a sheet of PTFE. The tension was used to keep the covered string straight and was approximately 2000 g. The PTFE acted as a reflective surface and spanned the length of the string. The assembly was then fed through an F300S Electrode-less UV Lamp System equipped with a D-bulb (467 W/in Max Power) on a LC-6B, Bench-top Conveyor provided by Fusion UV Systems, Inc., Gaithersburg, Md. Dosage was controlled by the conveyor speed, which was set to 3 ft/min.

Once each string exited the UV oven it was observed to have a tack-free surface, indicating that the imbibed resin had cured.

It was further noted that the cover conformed to each string. Each string was found to have good tone (that is, they sounded like traditional classical strings). The strings felt smoother and did not squeak as much as an uncovered string. Un-played covered strings were hung at ambient conditions for one month and did not tarnish over this time period.

Example 2

A second set of wound classical strings were obtained from D'Addario (part number EJ46C) and covered substantially as described in Example 1, except for the changes in the solvent/resin solution used, as discussed below. Expanded PTFE with a mass area of about 1.1 g/m$^2$ and a thickness of 0.0025 mm was obtained from W. L. Gore & Associates, Inc., Newark, Del. This film porosity was approximately 80%. A 75/25 weight percent MEK solvent to resin solution was prepared for imbibing the expanded PTFE film. The resin was 621 Series MULTI-CURE® urethane acrylate manufactured by Dymax Corporation, Torrington, Conn. This solvent-resin solution was dispensed and spread evenly across the expanded PTFE film. A liner was combined with the film as the solvent-resin solution penetrated the expanded PTFE film. Both the liner and imbibed film were sent through an oven (set at about 125° C.) to drive off the MEK solvent. The film was removed from the oven and a partially imbibed structure with imbibed resin coincident with the liner surface of the film and a thin surface coat present on the liner side was recovered. The surface coat covered some, but not all, of the expanded PTFE surface. The imbibed film was measured to be about 0.0024 mm thick. The mass area of the imbibed film was measured to be about 1.8 g/m$^2$.

Each string was covered and the resin cured as described in Example 1.

It was noted that the cover conformed to each string. Each string was found to have good tone (that is, they sounded like traditional classical strings). The tone sounded slightly brighter than the strings in Example 1. The strings felt smoother and did not squeak as much as an uncovered string. Un-played covered strings were hung at ambient conditions for one month and did not tarnish over this time period.

Comparative Example 1

A film of expanded PTFE (obtained from W. L. Gore and Associates, Inc., Newark, Del.) was coated with NEOFLON™ RP-4020 EFEP (Ethylene Tetra Fluoro Ethylene based copolymer, from Daikin Industries, Ltd.) by contacting one surface of the expanded PTFE substrate with a layer of NEOFLON RP-4020 EFEP. The assembly was heated to a temperature above the melting point of the NEOFLON RP-4020 EFEP and then stretched while maintaining that temperature. The assembly was then cooled to produce a film of expanded EPTFE coated with NEOFLON RP-4020 EFEP. This film was then slit down to a width of less than about 4 mm and wrapped in a helical fashion around each of the below D'Addario strings to produce 2 layers of film over the length of the string.

| String | Diameter | Core Material | D'Addario Part Number |
|---|---|---|---|
| E-6 | 0.046" | PEEK | J4606C |
| A-5 | 0.036" | PEEK | J4605C |
| D-4 | 0.029" | PEEK | J4604C |
| E-6 | 0.044" | Nylon | J4606 |
| A-5 | 0.036" | Nylon | J4605 |
| D-4 | 0.030" | Nylon | J4604 |

Each string was then placed in tension and heated at about 200 C for about 3 minutes.

Upon removal from the oven all strings were brittle. The strings were mounted on a classical guitar (Tacoma, Model CC10) and were found to have unacceptable tone.

Comparative Example 2

Comparative Example 1 was essentially repeated except using the thermoplastic fluoropolymer Dyneon™ HTE (hexafluoropropylene, tetrafluoroethylene, ethylene). Upon removal from the oven all strings were brittle. The strings were mounted on the same classical guitar as in Comparative Example 1 and were found to have unacceptable tone.

Example 3

A film of expanded PTFE (obtained from W.L. Gore and Associates, Inc., Newark, Del.) coated with the thermoplastic fluoropolymer Dyneon™ HTE (hexafluoropropylene, tetrafluoroethylene, ethylene) was constructed essentially as described in Comparative Example 1. This film was then applied to 23 D'Addario classical strings (part number: J4604C) as detailed in Comparative Example 1.

The strings were then heated with a hot air gun (Leister Type 3000 by Malcom Company, Inc.) traversing at 0.5 inches/second across the string. The hot air was regulated so that the temperature at the string measured about 240° C.

Upon cooling it was noted that the strings were not brittle. The strings were mounted on the same guitar as Comparative Example 1 and were found to have good tone.

Example 4

A film of expanded PTFE (obtained from W. L. Gore and Associates, Inc., Newark, Del.) coated with the thermoplastic fluoropolymer THV (tetrafluoroethylene, hexafluoropropylene, and vinylidene fluoride) was processed essentially as described in Comparative Example 1. This film was then applied to seven D'Addario classical strings (part number: J4604C) as detailed in Comparative Example 1.

The strings were then heated using the same hot air gun as used in Example 3 but traversing at about 1.5 inches/second across the string. The hot air was regulated so that the temperature at the string surface measured about 380° C. The traverse speed at this temperature was sufficient to keep the core of the string from melting.

The strings were not brittle upon removal from this process. The strings were mounted on the same guitar as Comparative Example #1 and were found to have good tone.

Example 5

This example compares the durability of the covered strings formed in accordance with Example 1, with the covered strings formed in Examples 3 and 4.

All of these samples were tested for durability by placing, them in tuning tension under a rotating wheel of picks. The picks were set at a constant depth for each sample tested. Each string received eight picks per second within a 2.5" segment of the string. The wheel of picks traversed over this segment at a constant rate of about 0.8 inch per second. The strings were checked every five minutes for wear. The string was deemed to have failed when the cover wore through such that the bare string could be seen.

Figure 15:
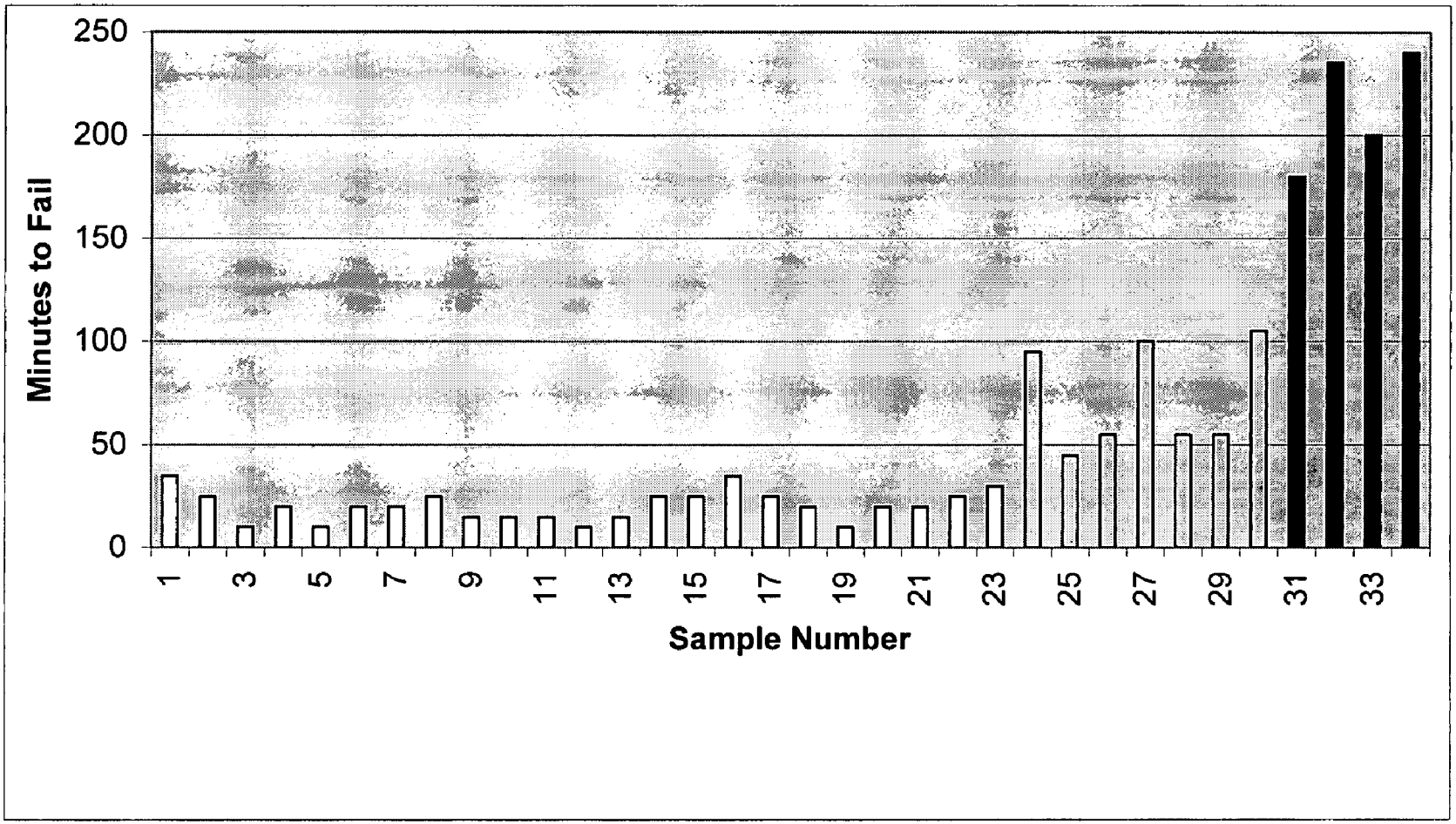
FIG. 15 is a graph comparing durability of strings formed according to Examples 1, 3 and 4.

FIG. 15 details the results of this Example. Specifically, Sample Numbers 1 through 23 are the covered strings from Example 3, all of which failed in under 50 minutes of testing. Sample Numbers 24 through 30 are the covered strings from Example 4, all of which showed some improvement over the covered strings of Example 3, but still failed in about 100 minutes or less. Finally, Sample Numbers 31 through 34 are 4 D'Addario classical strings (part number J4604C) covered as described in Example 1. Testing of each of Sample Numbers 31 through 34 was stopped before failure.

What is claimed:

1. A musical instrument string comprising:

a string; and a polymer cover combined with a low temperature resin covering at least a portion of the string, the low temperature resin comprising at least one material selected from the group consisting of thermoplastic resins that have a Melt Flow Rate of greater than about 1 gram/10 minutes under a test condition temperature of less than about 300° C. at a constant weight of about 5 Kg (as determined by ASTM D1238) and thermoset resins.

2. The musical instrument string of claim 1, wherein the polymer cover comprises at least some porosity, wherein at least a portion of the porosity is filled with the low temperature resin.

3. The musical instrument string of claim 1 wherein the string includes a core material selected from the group consisting of metal, gut, and synthetic material.

4. The musical instrument string of claim 3, wherein the core material comprises synthetic material.

5. The musical instrument string of claim 4, wherein the synthetic material is selected from the group consisting of nylon and polyetheretherketone.

6. The musical instrument string of claim 5, wherein the synthetic material comprises polyetheretherketone.

7. The musical instrument string of claim 1, wherein the string is a wound string.

8. The musical instrument string of claim 4, wherein the string is a wound string.

9. The musical instrument string of claim 1, wherein the resin is UV-cured.

10. The musical instrument string of claim 2, wherein the resin is U V-cured.

11. The musical instrument string of claim 8, wherein resin is UV-cured.

12. The musical instrument string of claim 1, wherein the polymer cover comprises fluoropolymer.

13. The musical instrument string of claim 2, wherein the polymer cover comprises fluoropolymer.

14. The musical instrument string of claim 2, wherein the low-temperature resin substantially fills the porosity of the polymer cover.

15. The musical instrument string of claim 13, wherein the low temperature resin substantially fills the porosity of the fluoropolymer cover.

16. The musical instrument string of claim 12, wherein the fluoropolymer comprises at least a material selected from the group consisting of polytetrafluoroethylene, fluorinated ethylene propylene, and perfluoro alkoxy resin.

17. The musical instrument string of claim 13, wherein the fluoropolymer is expanded polytetrafluoroethylene.

18. The musical instrument string of claim 17, wherein the low temperature resin substantially fills the porosity of the cover.

19. The musical instrument string of claim 10, wherein the UV-cured resin fills substantially all of the porosity of the polymer cover.

20. The musical instrument string of claim 2, wherein the low-temperature resin is also provided to at least one surface of the polymer cover.

21. The musical instrument string of claim 20, wherein the low-temperature resin is provided to the at least one surface of the cover as a discontinuous layer.

22. The musical instrument string of claim 20, wherein the low-temperature resin is provided to the at least one surface of the cover as a continuous layer.

23. The musical instrument string of claim 19, wherein the UV-cured resin is also provided to at least one surface of the polymer cover.

24. The musical instrument string of claim 23, wherein the UV-cured resin is provided to the at least one surface of the polymer cover as a discontinuous layer.

25. The musical instrument string of claim 23, wherein the UV-cured resin is provided to the at least one surface of the polymer cover as a continuous layer.

26. The musical instrument string of claim 15, wherein the resin is UV-cured.

27. The musical instrument string of claim 1, wherein the low temperature resin further comprises at least one filler material.

28. The musical instrument string of claim 2, wherein the low temperature resin further comprises at least one filler material.

29. The musical instrument string of claim 27, wherein the at least one filler material comprises at least a material selected from the group consisting of ceramics, metals, metal coated fillers, metallized fillers, carbon, and polymers.

30. The musical instrument string of claim 28, wherein the at least one filler material comprises at least a material selected from the group consisting of ceramics, metals, metal coated fillers, metallized fillers, carbon, and polymers.

31. The musical instrument string of claim 9, wherein the UV-cured resin comprises at least a material selected from the group consisting of urethane acrylates and cationic epoxies.

32. The musical instrument string of claim 10, wherein the UV-cured resin comprises at least a material selected from the group consisting of urethane acrylates and cationic epoxies.

33. A classical guitar string comprising:

a string; and a polymer cover combined with a low temperature resin covering at least a portion of the string, the low temperature resin comprises at least one material selected from the group consisting of thermoplastic resins that have a Melt Flow Rate of greater than about 1 gram/10 minutes under a test condition temperature of less than about 300° C. at a constant weight of about 5 Kg (as determined by ASTM D1238) and thermoset resins.

34. The classical guitar string of claim 33, wherein the polymer cover comprises at least some porosity, wherein at least a portion of the porosity is filled with the low temperature resin.

35. The classical guitar string of claim 33, wherein the string comprises a wound string.

36. The classical guitar string of claim 33, wherein the low temperature resin is UV-cured.

37. The classical guitar string of claim 34, wherein the low temperature resin is UV-cured.

38. The classical guitar string of claim 33, wherein the polymer cover comprises fluoropolymer.

39. The classical guitar string of claim 34, wherein the polymer cover comprises expanded polytetrafluoroethylene.

40. The classical guitar string of claim 39, wherein the low temperature resin substantially fills the porosity of the expanded polytetrafluoroethylene.

41. The classical guitar string of claim 38, wherein the fluoropolymer comprises at least a material selected from the group consisting of polytetrafluoroethylene, fluorinated ethylene propylene, and perfluoro alkoxy resin.

42. classical guitar string of claim 33, wherein the low temperature resin comprises thermoset resin.

43. The classical guitar string of claim 34, wherein the low temperature resin comprises thermoset resin.

44. The classical guitar string of claim 34, wherein the low temperature resin fills substantially all of the porosity of the polymer cover.

45. The classical guitar string of claim 34, wherein the low temperature resin is also provided to at least one surface of the cover.

46. The classical guitar string of claim 45, wherein the low temperature resin is provided to the at least one surface of the cover as a discontinuous layer.

47. The classical guitar string of claim 45, wherein the low temperature resin is provided to the at least one surface of the cover as a continuous layer.

48. The classical guitar string of claim 39, wherein the low temperature resin fills substantially all of the porosity of the polymer cover.

49. The classical guitar string of claim 48, wherein the low temperature resin is also provided to at least one surface of the polymer cover.

50. The classical guitar string of claim 49, wherein the low temperature resin is provided to the at least one surface of the polymer cover as a discontinuous layer.

51. The classical guitar string of claim 49, wherein the low temperature resin is provided to the at least one surface of the polymer cover as a continuous layer.

52. The classical guitar string of claim 33, wherein the resin further comprises at least one filler material.

53. The classical guitar string of claim 34, wherein the resin further comprises at least one filler material.

54. The classical guitar string of claim 52, wherein the at least one filler material comprises at least a material selected from the group consisting of ceramics, metals, metal coated fillers, metallized fillers, carbon, and polymers.

55. The classical guitar string of claim 53, wherein the at least one filler material comprises at least a material selected from the group consisting of ceramics, metals, metal coated fillers, metallized fillers, carbon, and polymers.

56. The classical guitar string of claim 36, wherein the UV-cured resin comprises at least a material selected from the group consisting of urethane acrylates and cationic epoxies.

57. The classical guitar string of claim 37, wherein the UV-cured resin comprises at least a material selected from the group consisting of urethane acrylates and cationic epoxies.

58. A musical instrument string comprising:

a wound string; and a polymer cover surrounding at least a portion of the wound string, the cover being attached to the wound string through use of a low temperature UV-cured adhesive, the low temperature UV-cured adhesive comprising at least one material selected from the group consisting of thermoplastic resins that have a Melt Flow Rate of greater than about 1 gram/10 minutes under a test condition temperature of less than about 300 C at a constant weight of about 5 Kg (as determined by ASTM D1238) and thermoset resins.

59. The musical instrument string of claim 58, wherein the polymer cover comprises at least some porosity and at least a portion of the porosity is filled with the low temperature UV-cured adhesive.

60. The musical instrument string of claim 58, wherein the string includes a core material selected from the group consisting of metal, gut, and synthetic material.

61. The musical instrument string of claim 60, wherein the core material comprises synthetic material.

62. The musical instrument string of claim 61, wherein the synthetic material is selected from the group consisting of nylon and polyetheretherketone.

63. The musical instrument string of claim 58, wherein the polymer cover comprises fluoropolymer.

64. The musical instrument string of claim 59, wherein the polymer cover comprises fluoropolymer.

65. The musical instrument string of claim 59, wherein the low temperature UV-cured adhesive substantially fills the porosity of the polymer cover.

66. The musical instrument string of claim 64, wherein the low temperature UV-cured adhesive substantially fills the porosity of the fluoropolymer cover.

67. The musical instrument string of claim 63, wherein the fluoropolymer comprises at least a material selected from the group consisting of polytetrafluoroethylene, fluorinated ethylene propylene, and perfluoro alkoxy resin.

68. The musical instrument string of claim 67, wherein the fluoropolymer comprises expanded polytetrafluoroethylene.

69. The musical instrument string of claim 64, wherein the fluoropolymer comprises at least a material selected from the group consisting of polytetrafluoroethylene, fluorinated ethylene propylene, and perfluoro alkoxy resin.

70. The musical instrument string of claim 69, wherein the fluoropolymer comprises expanded polytetrafluoroethylene.

71. The musical instrument string of claim 58, wherein the low temperature UV-cured adhesive further comprises at least one filler material.

72. The musical instrument string of claim 59, wherein the low temperature UV-cured adhesive further comprises at least one filler material.

73. The musical instrument string of claim 71, wherein the at least one filler material comprises at least a material selected from the group consisting of ceramics, metals, metal coated fillers, metallized fillers, carbon, and polymers.

74. The musical instrument string of claim 72, wherein the at least one filler material comprises at least a material selected from the group consisting of ceramics, metals, metal coated fillers, metallized fillers, carbon, and polymers.

75. The musical instrument string of claim 58, wherein the low temperature UV-cured adhesive comprises at least a material selected from the group consisting of urethane acrylates and cationic epoxies.

76. The musical instrument string of claim 59, wherein the low temperature UV-cured adhesive comprises at least a material selected from the group consisting of urethane acrylates and cationic epoxies.

* * * * *